United States Patent [19]

Poon

[11] Patent Number: 4,716,616

[45] Date of Patent: Jan. 5, 1988

[54] FLEXIBLE SQUEEGEE DEVICE

[76] Inventor: Patrick Poon, 441 Esna Park Drive, Unit 8, Markham, Ontario, Canada, L3R 1H7

[21] Appl. No.: 27,316

[22] Filed: Mar. 18, 1987

[51] Int. Cl.[4] ..... A47L 13/11

[52] U.S. Cl. ..... 15/245; 15/144 R; 15/145

[58] Field of Search ..... 15/144 R, 145, 176, 15/245, 250.32, 250.42; 16/114 R

[56] References Cited

U.S. PATENT DOCUMENTS

| | | | |
|---|---|---|---|
| 1,579,941 | 4/1926 | Jenkins | 15/145 |
| 2,681,464 | 6/1954 | Baril | 15/144 R |
| 3,879,794 | 4/1975 | Roberts | 15/250.42 |
| 4,006,510 | 2/1977 | Soares | 15/245 |
| 4,127,911 | 12/1978 | Cupp et al. | 15/145 |
| 4,236,270 | 12/1980 | Mavis | 15/145 |
| 4,611,363 | 9/1986 | Samuelsson | 15/245 |

*Primary Examiner*—Philip R. Coe
*Assistant Examiner*—Corinne M. Reinckens
*Attorney, Agent, or Firm*—David W. Wong

[57] ABSTRACT

The squeegee device is for cleaning both flat and curved surfaces. It has a handle and a squeegee blade assembly mounted together by a rigid coupling bracket to form a rugged joint. The handle can be positioned in one of at least four positions relative to the blade assembly to facilitate either a push and pull cleaning operation or a side-by-side sweeping cleaning operation.

10 Claims, 12 Drawing Figures

FLEXIBLE SQUEEGEE DEVICE

BACKGROUND OF THE INVENTION

The present invention relates to a squeegee device for cleaning purposes and particularly to a flexible squeegee device suitable for use in cleaning flat as well as curved surfaces.

Common squeegee type cleaning devices consist of an elongated rubber-like strip member mounted on a frame and a handle is, in turn, mounted perpendicular to the centre of the frame to form a T-shaped structure. Such squeegee devices are effective for cleaning a flat surface, for example, a window pane. However, it is not suitable for cleaning curved surfaces such as modern automobile windows and/or automobile body. Furthermore, such cleaning devices can only operate in the direction along the axis of the handle. In use, the operator grips the handle and presses the strip member on the flat surface to be cleaned and slides the strip member over the surface towards the end of the handle. Thus, the cleaning operation is achieved in each single pulling action only.

Some squeegee devices provide a pressure joint such as a ball joint between the handle and the strip frame so that the strip member can be rotated to a position in any angle relative to the handle. Such squeegee devices can be operated in the pull-in direction as described above as well as in a side-by-side sweeping motion over the surface to be cleaned. However, such known squeegee devices suffer the main drawback that the joint between the strip member mounting frame and the handle is not rugged. After using them for a relatively short period of time, the joint would become loosen beyond repair and become freely rotatable or merely become broken due to the high twisting force exerted at the joint during use.

OBJECT OF THE INVENTION

The principal object of the present invention is to provide a squeegee device having a strong rugged joint between the blade assembly frame and the handle and yet provides the flexibility to vary their relative position for cleaning in a pull-in action as well as a side-by-side sweeping action.

Another object of the present invention is to provide a squeegee device which has a flexible blade assembly operative for cleaning flat as well as curved surfaces.

It is another object of the present invention to provide a squeegee device in which the position of the mounting coupling between the handle and the blade assembly can be selectively adjustable to any position along the blade assembly.

It is yet another object of the present invention to provide a squeegee device which can be disassembled readily for parts displacement or storage.

SUMMARY OF THE INVENTION

The squeegee device comprises a handle, a coupling member and a blade assembly slidably mounted together. The coupling member has a coupling housing having an opened end and a square mounting head is provided at the free end of the handle. The mounting head can be slidably engaged with the coupling housing in any one of four selective positions to provide a rugged joint.

BRIEF DESCRIPTION OF THE DRAWINGS

Other objects of the invention will appear in the following description and appended claims, reference being made to the accompanying drawings in which:

DESCRIPTION OF SPECIFIC EMBODIMENTS

Figure 1:
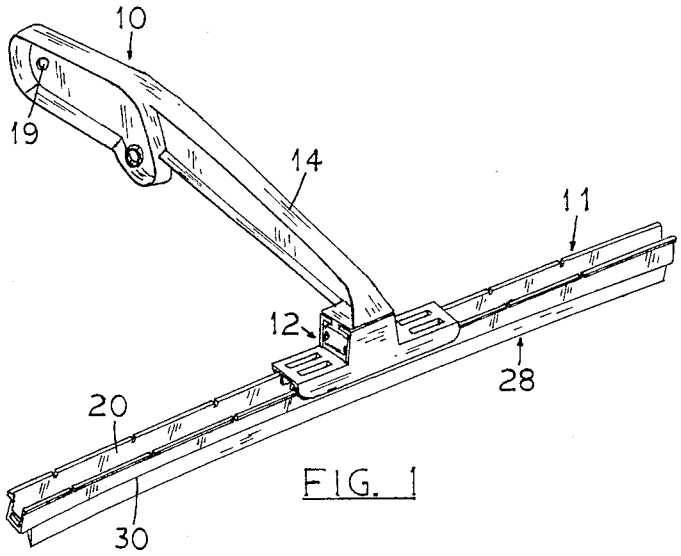
FIG. 1 is a perspective front elevation view of a cleaning device showing the blade assembly mounted perpendicular to the handle according to the present invention.

Referring now to the drawings wherein like reference numerals designate corresponding parts in the several views, the squeegee device according to the present invention consists generally of a handle 10, a flexible blade assembly 11 and a coupling bracket 12 for mounting the handle 10 and the blade assembly 11 together. The handle 10 includes a rear hand grip 13 and an extension front portion 14 extending forwardly and downwardly from the front end of the hand grip 13 to a substantially rectangular front free end 15. A square mounting head 16 is provided at the front free end 15. The mounting head 16 is spaced from the front free end 15 by a neck 17 which has a smaller cross sectional dimension than the mounting head 16.

The handle 10 may be made of moulded plastic material or extruded metal or metal alloy and is generally I-shaped in cross section and has raised edge portions 18 on both sides to provide rigidity and reinforcement therein. An opening 19 is provided adjacent to the rear end of the handle 10 for hanging the squeegee device or the handle in storage.

Figures 3, 4, 5, 6, 7, 8, 9, 10:
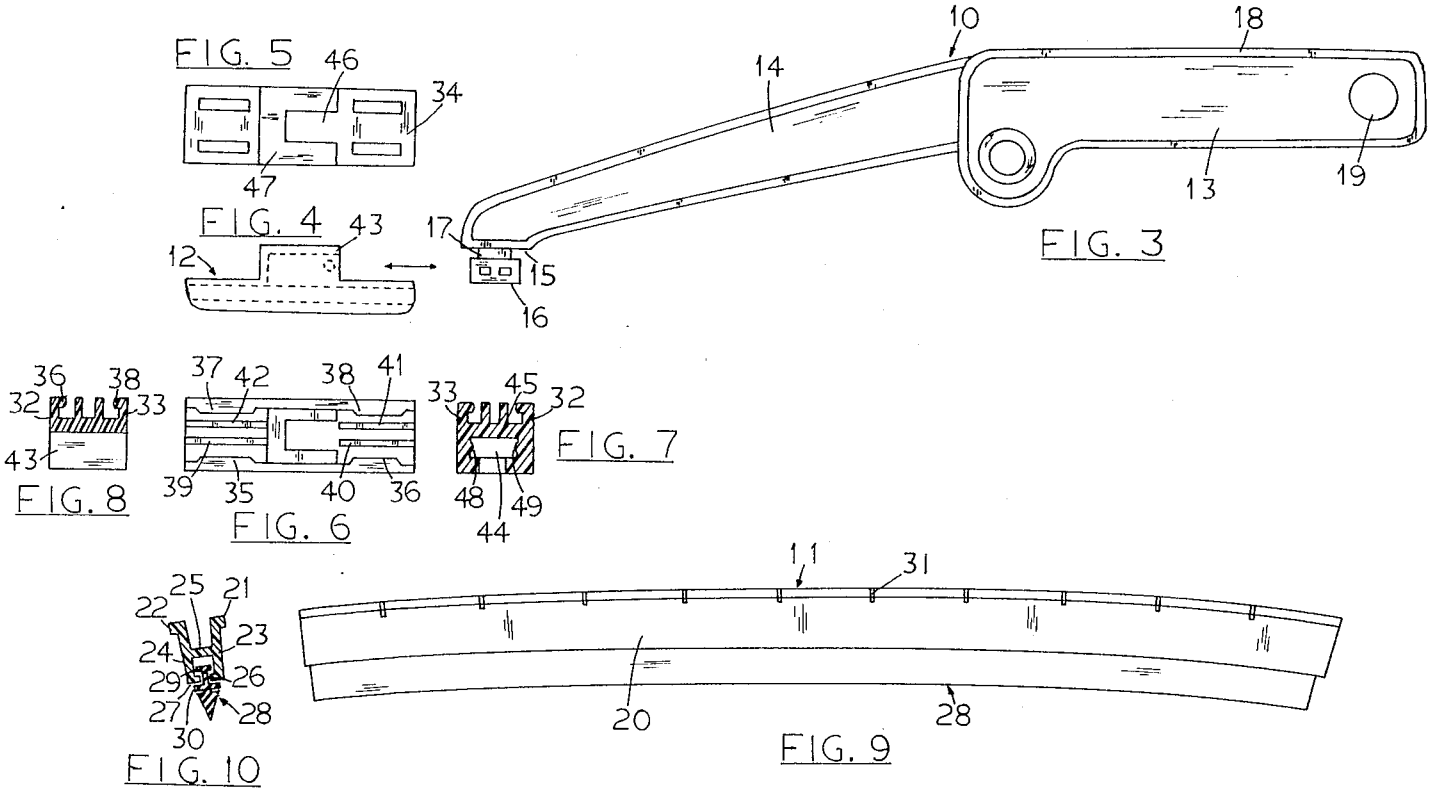
FIG. 3 is a side elevation view of the handle of the cleaning device according to the present invention.
FIG. 4 is a side elevation view of the coupling member between the handle and the blade assembly thereof.
FIG. 5 is a top elevation view of the coupling member thereof.
FIG. 6 is a bottom elevation view of the coupling member thereof.
FIG. 7 is an end elevation view of the coupling member thereof.
FIG. 8 is an opposite end elevation view to the coupling member in FIG. 7 thereof.
FIG. 9 is a side elevation view of the blade assembly thereof.
FIG. 10 is an end elevation view of the blade assembly thereof.

The blade assembly 11 consists of an elongated flexible channel frame member 20 having a U-shaped cross section as best shown in FIG. 10. It includes two flanges 21 and 22 extending outwards along the upper edges of the upstanding lateral sides 23 and 24 respectively. A cross brace 25 extends between the upstanding sides 23 and 24 and along the full length of the channel frame member 20 to provide reinforcement for the sides 23 and 24. A slot 26 is formed in the base 27 of the channel frame member 20 for sliding engagement with a rubber blade 28 similar to that in common automobile windshield wiper blades. Such blade is more flexible than the stiff wide rubber blade used in common non-flexible squeegee devices and it can readily conform to the curvature of the surface to be cleaned by pressing it over such surface. The flexible blade has an I-shaped cross section at its upper portion as best shown in FIG. 10 having an upper cross web portion 29 and a middle flange 30 both extending the full length of the blade 28. The blade is secured to the channel frame member 20 by slidingly engaging the neck portion between the upper cross web portion 29 and the middle flange 30 with the slot 27 in the channel frame member 20. The middle flange 20 also serves to transmit to the blade 28 the force exerted on the channel frame member 20 during use. The frame 20 may be also made of moulded plastic material or extruded metal or metal alloy having a slight flexible characteristic, and the frame 20 is normally curved downwards towards the two ends therein so that it can conform to curved surfaces for cleaning. Slots 31 may be formed at regular intervals along the flanges 21 and 22 and the upper edges of the sides 23 and 24 to provide more flexibility to the blade assembly.

The coupling bracket 12 is generally inverted U-shaped; it has two skirting sides 32 and 33 and a top platform 34. The distance between the inside surface of the skirting sides 32 and 33 is slightly less than the distance between the lateral outside edges of the flanges 21 and 22 of the flexible channel frame member 20. Four horizontal ridges 35, 36, 37 and 38 are formed in the inside edge portions of the skirting sides 32 and 33 as best shown in FIGS. 7 and 8. Also, four downwardly extending spaced vertical ridges 39, 40, 41 and 42 are formed in the underside of the platform 34. For reason which will become apparent in the following description the horizontal ridges 35, 36 and 37, 38 may be formed in a pair of ridges extending the full length of the skirting sides 32 and 33. Similarly, the vertical ridges 39, 40 and 41, 42 may be in the form of a pair of spaced ridges extending the entire length of the platform 34. A rectangular housing 43 is formed on the top platform 34. The housing 43 has an opened side 44 and its interior length 45 is slightly longer than the square mounting head 16 of the handle 10 while its interior width is equal to that of the mounting head 16. A slot 46 is provided in the top panel 47 of the housing 43. The slot 46 is opened at the opened side 44 of the housing 43 and its width is equal to the width of the neck 17 on the handle 10. Two small rounded projections 48 and 49 are provided on the inside surface of the two side portions of the housing 43 adjacent to the opened side 44 such that the remaining interior space inside the housing 43 forms a square compartment equal in size to the square head 16 on the handle 10.

The coupling bracket 12 can be slidably mounted to the blade assembly 11 by sliding the bracket 12 through the end of the blade assembly 11 such that the flanges 21 and 22 engage snugly with the ridges 35, 36 and 37, 38 respecively while thee vertical ridges 39, 30 and 41, 42 slidably engage with the inside surface of the sides 23 and 24 of the flexible frame 20. The bracket 12 may be thus selectively fixed at any position along the length of the flexible frame 20. The handle may then be mounted to the coupling bracket 12 by slidably engage the mounting head 16 of the handle through the opened side 44 and slot 46 of the housing 43 until it passes the projections 48 and 49 which provide a locking action to fixedly secure the mounting head in place in the housing. It can be appreciated that due to the positive engagement between the mounting head 16 and the housing 43, a rugged and rigid joint is thus formed which is not subject to distortion or rotational movement even under the strong pressure exerted at the joint during use.

Figure 2:
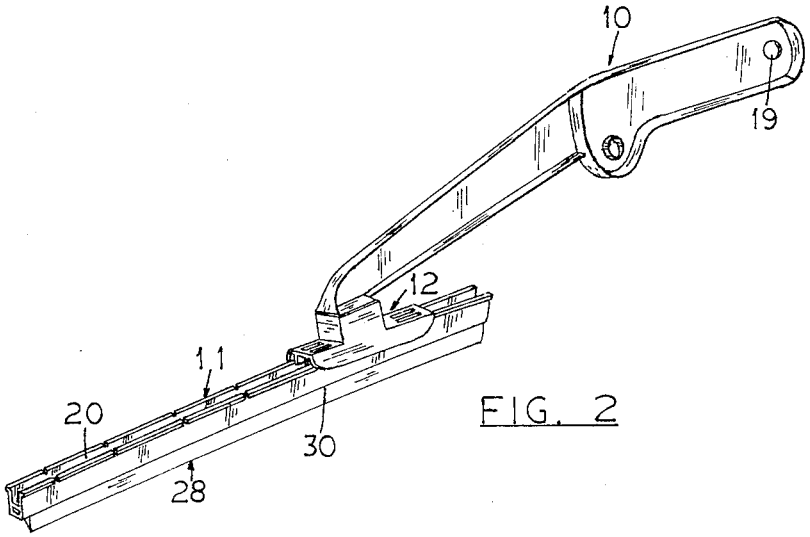
FIG. 2 is a second perspective front elevation view thereof showing the blade assembly mounted parallel to the handle thereof.

The handle 10 may be mounted to the coupling bracket 12 in one of four selected positions namely, two positions with the two parts parallel to each other such that the handle 10 points to either end of the blade assembly, and the other two positions with the two parts perpendicular to each other such that the handle 10 extends on either side of the blade assembly 11. Furthermore, the coupling bracket 12 may be located in any position along the flexible frame 20 to provide various selected configurations between the handle 10 and the blade assembly 11 to accommodate various situations encountered in use. For example, as best shown in Figure 2, the handle 10 can be mounted parallel to the blade assembly 11 and the coupling bracket 12 may be positioned adjacent to the end of the flexible frame 20 pointing to the end of the handle; in such a configuration, the maximum length of the squeegee device according to the present invention can be obtained.

Since all component parts of the squeegee device according to the present invention are slidably engaged together, it can be easily disassembled for storage or replacement of parts. Moreover, due to the flexibility of the cleaning blade assembly 11 it can be used effectively for for cleaning flat surfaces as well as curved surfaces.

It can further be appreciated that the coupling bracket 12 may be integrally and fixedly formed on the flexible frame 20. In such construction, the position of the coupling bracket 12 can not be changed along the flexible frame 20.

Figure 11:
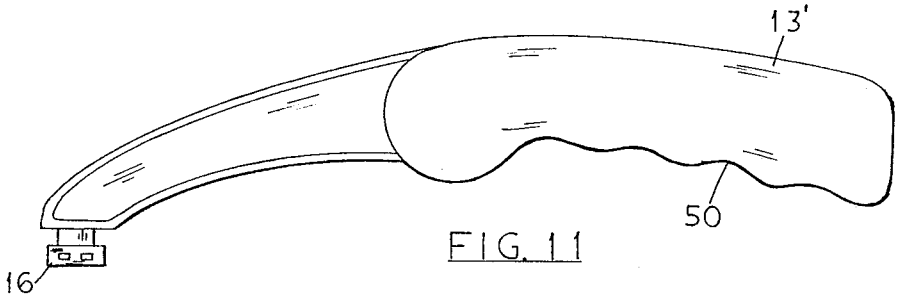
FIG. 11 is a side elevation view of an alternative handle thereof.
Figure 12:
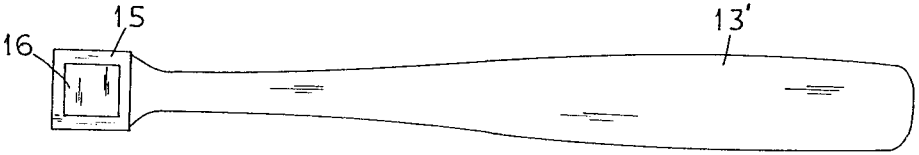
FIG. 12 is a bottom elevation view of the alternative handle thereof.

The handle 10 may also have an alternative shape as shown in FIGS. 11 and 12. The handle has a larger curvature and the hand grip portion 13' has a more rounded shape for more comfortable fitting to the user's palm. Also, curved depressions 50 may additionally be provided along the lower edge therein for firmer fitting to the user's fingers.

While the invention has been particularly shown and described with reference to a preferred embodiment thereof, it will be understood by those skilled in the art that various changes in form and detail may be made therein without departing form the spirit and scope of the invention.

I claim:

1. A squeegee device comprising, an elongated flexible frame member, an elongated resilient strip element mounted to one lateral edge of said frame member, a bracket member coupled to said frame member in a second lateral edge therein opposite to said one lateral edge, said bracket member having a substantially rectangular mounting housing portion provided with an opened side, and a slotted top cover having an opened end at said opened side, a handle member having a substantially square head portion formed in a free end therein, said mounting head portion being operatively engageable with said mounting housing portion of said bracket member for mounting said handle member and said bracket member selectively in at least two positions wherein in one position said handle member is substantially perpendicular to said bracket member, and in a second position said handle member is substantially parallel to said bracket member.

2. A squeegee device according to claim 1 wherein said mounting housing portion of said bracket member is formed at a top panel of said bracket member.

3. A squeegee device according to claim 2 wherein said mounting housing portion of said bracket member has an interior width equal to the cross sectional dimension of said square mounting head portion on said handle member.

4. A squeegee device according to claim 3 including two locking projection means formed on two side walls of said mounting housing portion and being located adjacent to said opened end.

5. A squeegee device according to claim 4 wherein said bracket member has a generally inverted U-shaped cross section having two skirting sides and a top platform, and said mounting housing portion being located at a centre portion of said top platform.

6. A squeegee device according to claim 5 wherein said bracket member includes at least two horizontal ridge members formed at the inside edge portions of said skirting sides and at least two spaced vertical ridge members extending downwardly from said top platform.

7. A squeegee device according to claim 6 wherein said flexible frame member comprises an elongated channel member having a U-shaped cross section including two upstanding sides and a base portion, said resilient strip element being mounted to said base portion, and said upstanding sides having two flange portions extending horizontally outwards along upper edges therein, said flange portions being operatively slidably engageable with said horizontal ridge members and vertical ridge members of said bracket member for mounting said bracket member and channel member together.

8. A squeegee device according to claim 7 wherein said elongated channel member is curved downwardly towards two ends therein, and a plurality of slots are formed in evenly spaced intervals along said flange portions and upper edges.

9. A squeegee device according to claim 8 wherein said flexible member, bracket member and handle member are made of moulded plastic material.

10. A squeegee device comprising an elongated flexible channel member having a generally U-shaped cross section, and having two upstanding sides and a base portionn, two flange portions extending outwardly from upper edges of said upstanding sides and an elongated slot formed in said base portion, an elongated rubber strip member secured to said flexible channel member along said slot of said base, a bracket member having a generally inverted U-shape cross section including skirting sides and a top platform, a mounting housing formed at a centre portion of said top platform, said mounting housing having an opened side and a top panel provided with a slot opend at said opened side, at least two horizontal ridges located at an inside edge portion of said skirting sides, and two spaced vertical ridges extending downwardly from said platform, said bracket member being operative slidably engageable with said flexible channel member by slidably engaging said flange portions with said horizontal and vertical ridges, an elongated handle member having a square mounting head formed in a free end therein, said square head being slidably and lockingly engageable with said mounting housing for mounting said handle to said bracket member in one of four selected positions.

* * * * *